United States Patent [19]

Cross et al.

[11] 3,941,369

[45] Mar. 2, 1976

[54] SHEET DISTRIBUTING APPARATUS

[75] Inventors: Thomas R. Cross, Rochester; Clifford L. George, Macedon, both of N.Y.

[73] Assignee: Xerox Corporation, Stamford, Conn.

[22] Filed: Dec. 9, 1974

[21] Appl. No.: 530,906

[52] U.S. Cl. ..... 271/64

[51] Int. Cl.[2] ..... B65H 31/24

[58] Field of Search ..... 271/64, 173; 270/58

[56] References Cited

UNITED STATES PATENTS

| | | | |
|---|---|---|---|
| 2,990,174 | 6/1961 | Kimbrough | 271/173 |
| 3,516,654 | 6/1970 | Mestre | 271/173 |
| 3,774,902 | 11/1973 | Schulze | 270/58 |

*Primary Examiner*—Evon C. Blunk
*Assistant Examiner*—Robert Saifer

[57] ABSTRACT

Sheet distributing apparatus for a sorter which includes a plurality of bins for receiving copy sheets advanced from a processor. Extending along the sheet path adjacent to the inlets of the bins are a pair of helical screw members which rotatably support and advance a carriage carrying deflector members which direct the copy sheets into the bins. The drive for rotating the helical screw members include a motor spring which drive a single revolution latching device to provide intermittent movement of the carriage past the inlets of each of the bins. A clutch which is connected to the drive of the sheet transport rewinds the motor spring after untensioning thereof after a sorting run.

5 Claims, 7 Drawing Figures

SHEET DISTRIBUTING APPARATUS

This invention relates in general to sheet distributing apparatus and in particular to an apparatus for distributing copy sheets into sorter bins which copy sheets are produced from electrostatographic printing machines or the like. The instant application incorporates by reference U.S. Pat. No. 3,567,214 issued on Mar. 2, 1971 on a document feeder commonly assigned herewith.

Prior art sheet sorters have encountered increasing demands in the sorting of copy sheets fed from high speed electrostatographic printing machines. Many of the prior art sorting devices are in the form of modules which are added onto the printing machines in sufficient numbers to accommodate the job requirements as described, for example in U.S. Pat. Nos. 3,638,937, 3,774,906 and 3,802,694. While these prior art devices are satisfactory for handling a variety of job loads, they are not entirely suitable for rigid space requirements necessitating compact design while enabling reliable sheet distribution to the sorter bins and ease of access to sorter components to clear jams, etc.

It is an object of this invention to improve sorting apparatus used with copier/duplicator machines.

It is a further object of this invention to improve the production of collated copy sets printed by a copy machine.

It is another object of this invention to provide a compact bin arrangement for a sorting apparatus.

It is another object of this invention to improve the distribution of copy sheets into sorter bins.

These and other objects of the instant invention are achieved generally speaking by arranging copy bins along a sheet transport and moving carriage to deflect sheets into the bins while opening the spacing therebetween.

For a better understanding of the invention as well as other objects and further features thereof, reference is had to the following detailed description of the invention which is to be read in conjunction with the accompanying drawings wherein:

FIG. 4(*a*) is a sectional view of the pivot mounting of a sorting bin of FIG. 4 taken along line 4*a*—4*a;*

Figure 1:
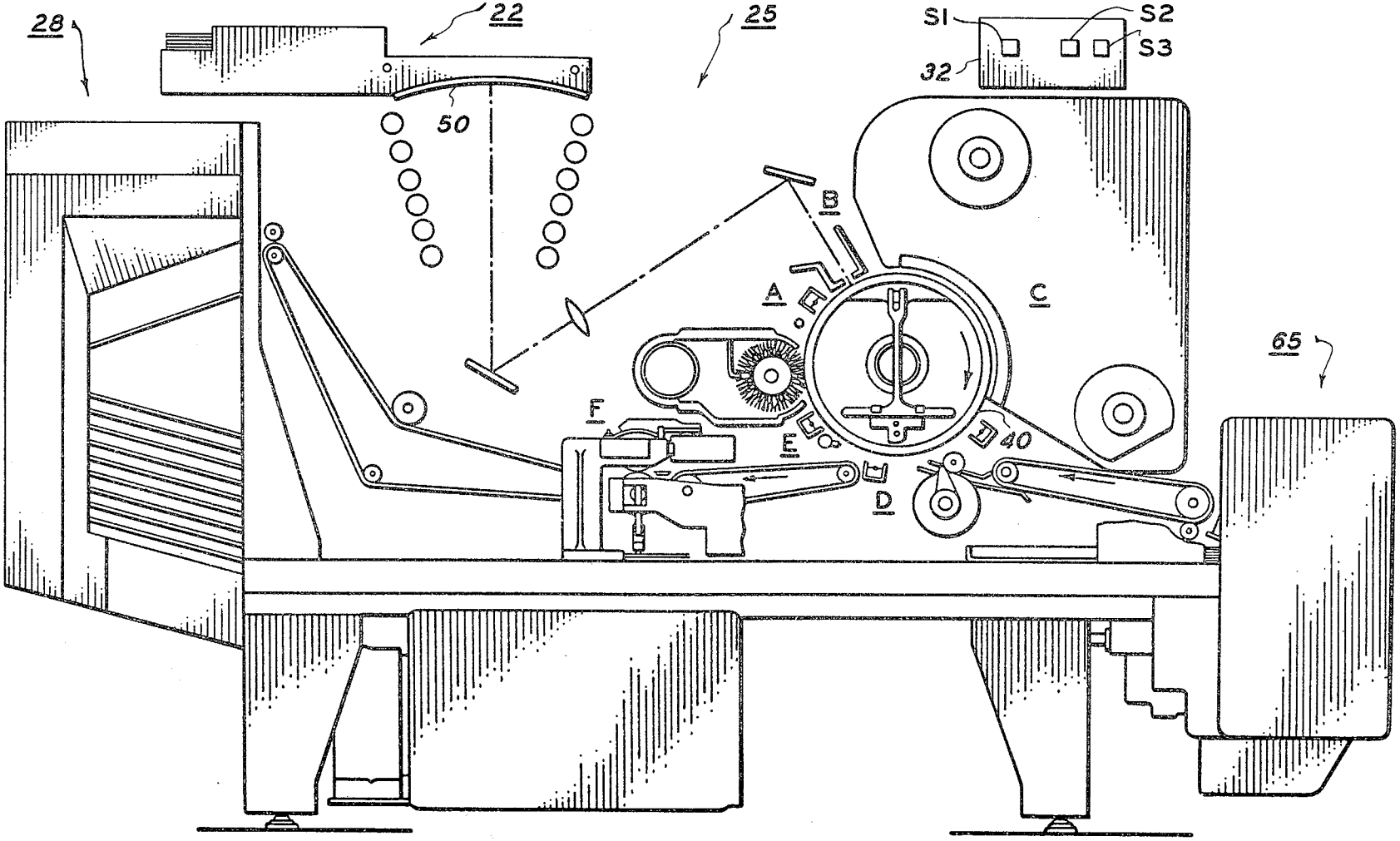
FIG. 1 illustrates schematically electrostatographic reproducing system including sorting apparatus in accordance with the instant invention.
Figure 2:
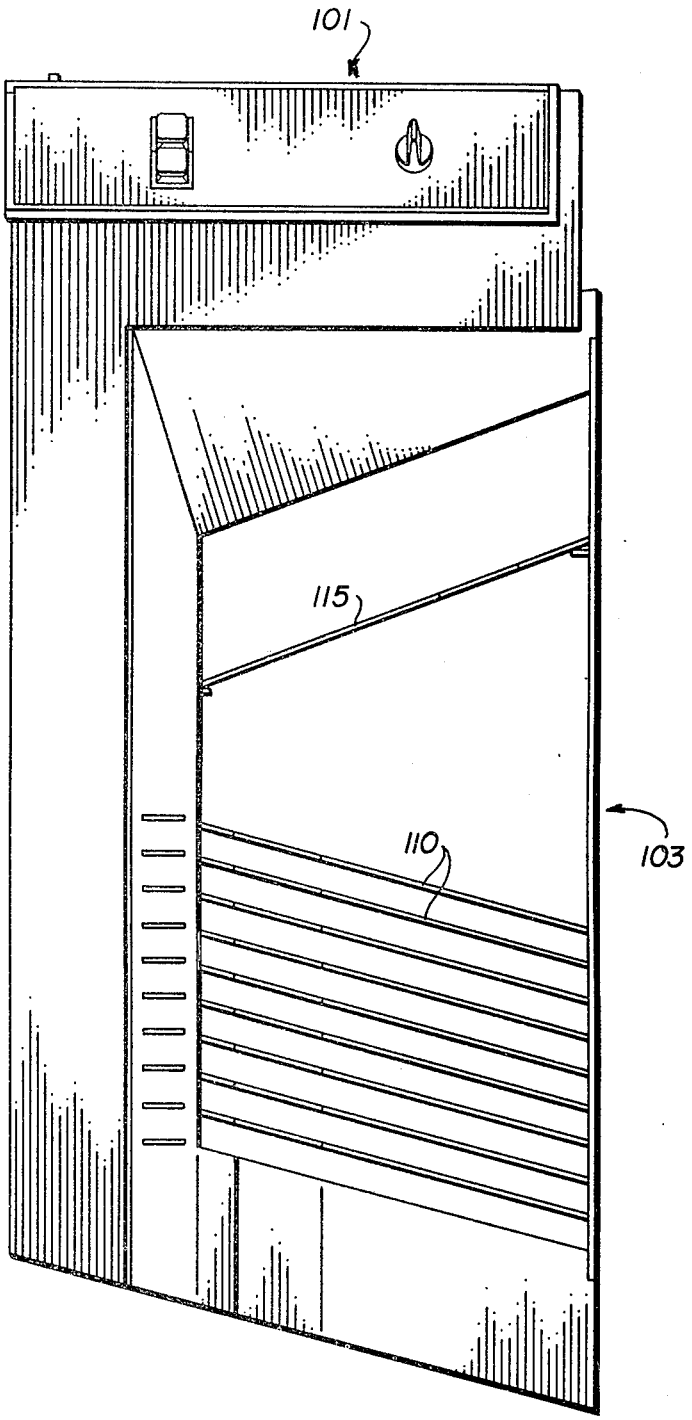
FIG. 2 is a front elevation view of the sorting apparatus according to the invention.
Figure 3:
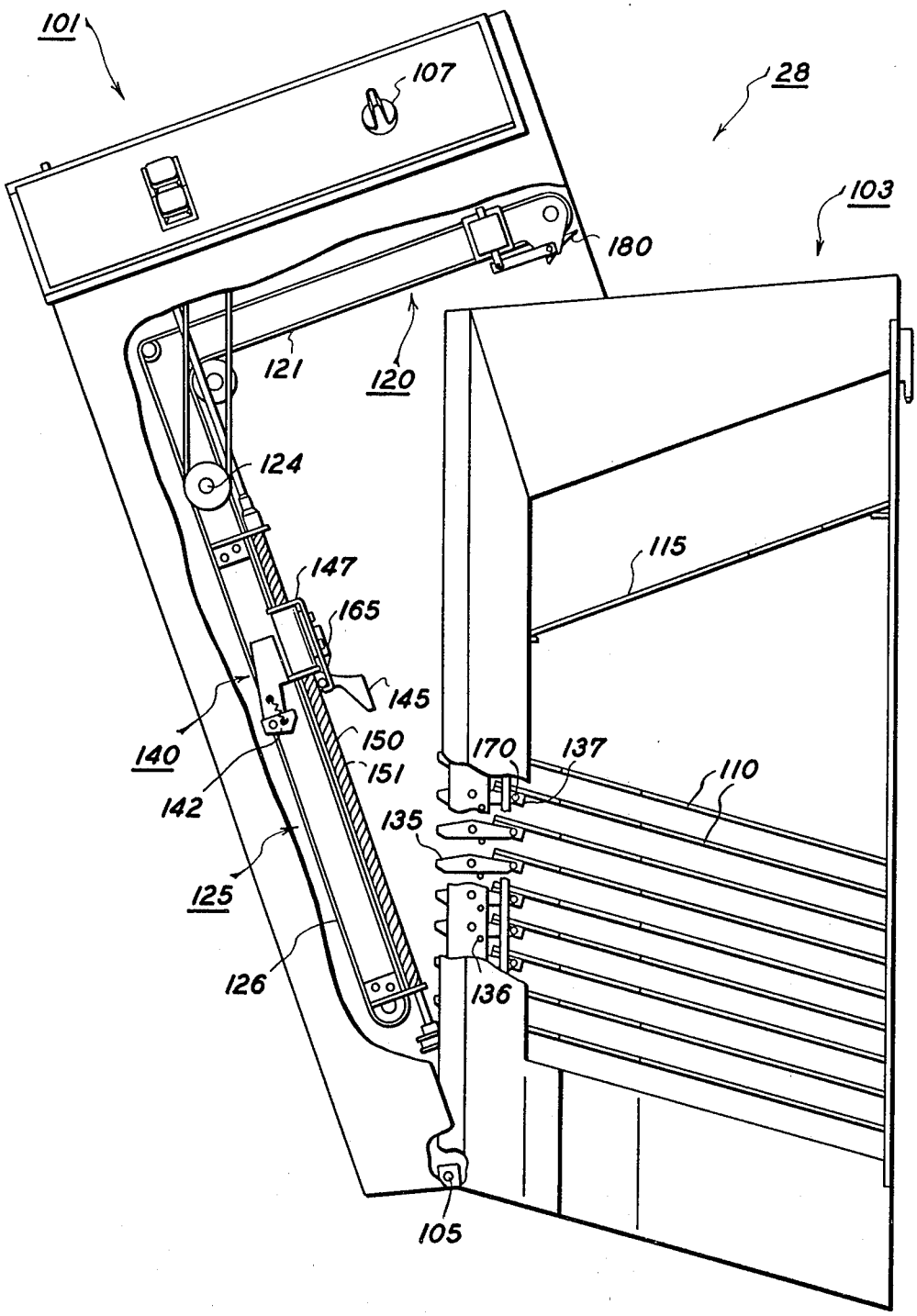
FIG. 3 is a view similar to FIG. 2 with the sorting apparatus in an opened position.
Figure 4:
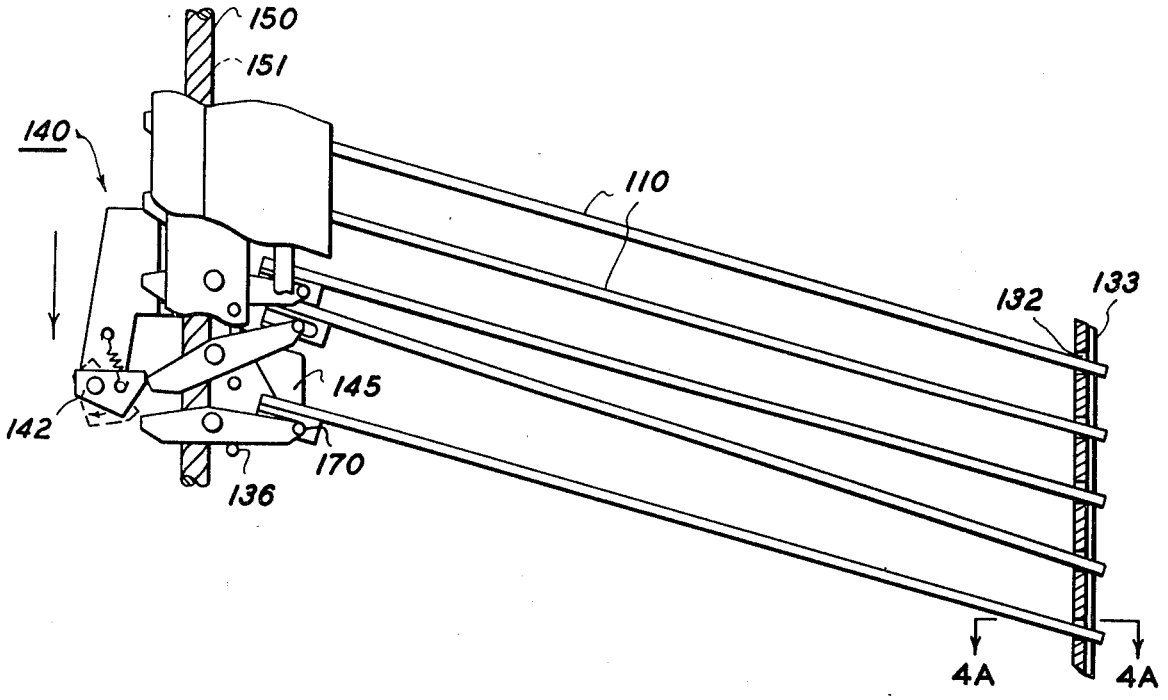
FIG. 4 is an exploded view of the sheet distributing mechanism and the sorting bins.
Figure 4A:
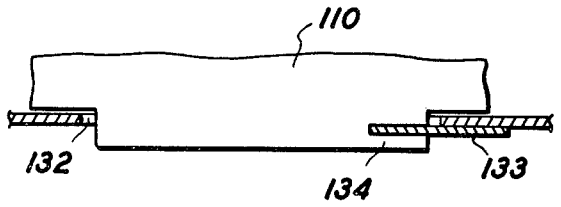
Figure 5:
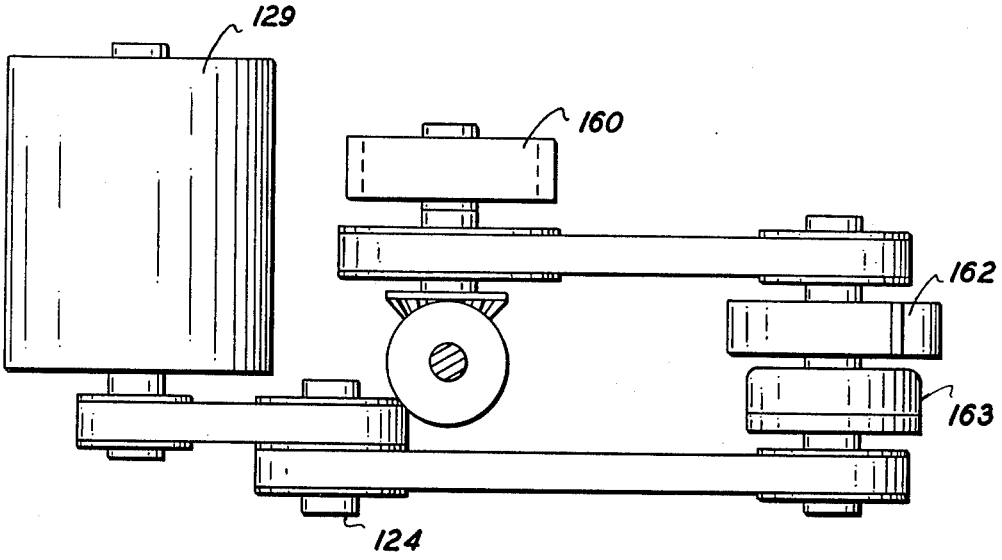
FIG. 5 is a top view of the drive for the sheet distributing mechanism of the sorting apparatus.
Figure 6:
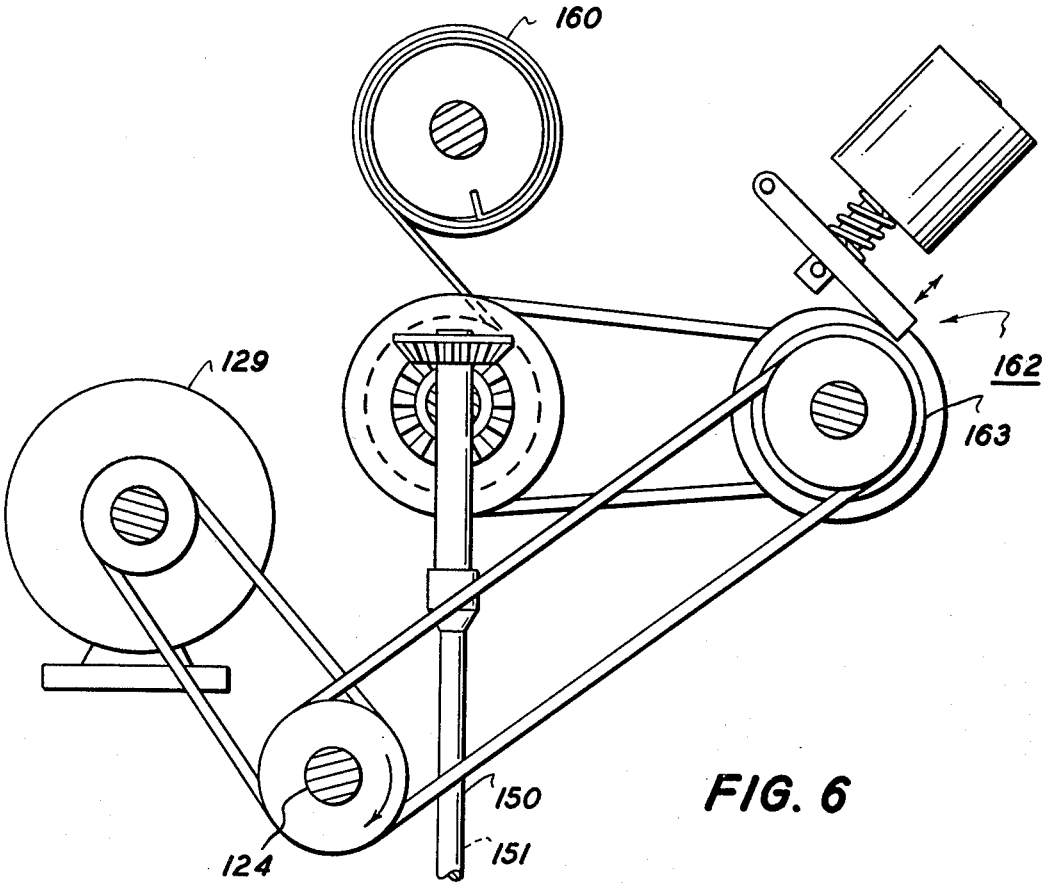
FIG. 6 is an elevation of the drive.

As shown schematically in FIG. 1 the electrostatographic reproducing system comprises a document feeding apparatus 22, positioned on a xerographic processor 25 which transport copy sheets to a sorting apparatus 28 for sorting in accordance with the invention. A control panel 32 includes the usual counters and buttons as well as button S1 for START PRINT, S2 for sorter ON and S3 for sorter OFF. The processor includes a drum shaped surface 40 including a photoconductive backing. This surface is mounted on a shaft journalled in a frame to rotate in the direction of the arrow to cause the drum surface sequentially to pass a plurality of xerographic processing stations.

For the purpose of the present disclosure, the several xerographic processing stations in the path of movement of the drum surface may be described functionally as follows:

A charging station A, at which a uniform electrostatic charge is deposited on the photoconductive layer of the xerographic drum;

An exposure station B, at which a light or radiation pattern of copies to be reproduced is projected onto the drum surface to dissipate the drum charge in the exposed areas thereof and thereby form a latent electrostatic image of the copy to be reproduced;

A developing station C, at which a xerographic developing material including toner particles having an electrostatic charge opposite to that of the electrostatic latent image are cascaded over the drum surface, whereby the toner particles adhere to the latent electrostatic image for a xerographic powdered image in configuration of the copy being reproduced;

A transfer station D, at which the xerographic powder image is electrostatically transferred from the drum surface to a transport sheet material or drum surface;

A drum cleaning and discharge station E, at which the drum surface is brushed to remove residual toner particles remaining thereon after image transfer, and at which the drum surface is exposed to a relatively bright light source to effect substantially complete discharge of any residual electrostatic charge remaining thereon; and A fusing station F, at which the powder image is permanently affixed to the sheet material which is transported to sorting apparatus 28.

For a more detailed description of the copy processing stations reference is had to U.S. Pat. No. 3,301,126 to Osborne et al which is commonly assigned.

Referring now to FIGS. 2–6 the sorting apparatus 28 includes modular assemblies 101 and 103. Assembly 101 is positioned on the outside and is hinged to pivot on an axis through a mounting 105 upon turning knob 107. Modular assembly 103 is secured inside to the end frame of processor 25. Assembly 103 includes bins or trays 110 which receive the copy sheets printed from documents fed from document feeding apparatus 22. Also included is a main or overflow tray 115 which is used in the non-sort mode of operation or as an overflow for the sort-mode of operation as will be explained more fully hereinafter.

Modular assembly 101 houses horizontal transport 120 and vertical transport 125 which incorporates a vacuum to advance copy sheets from the processor into the sorting bins 110. Transport 120 includes belts 121 which are driven by a shaft 124. Transport 125 includes belts 126 which are also driven by shaft 124. Shaft 124 is driven from a main drive motor 129 mounted in assembly 101. Transport 120 is mounted to the transport 125 via bearings on common shaft 124. Vacuum is provided through holes of transport belts 121 and 126 via a centrifical type blower or the like (not shown) which is driven by main drive motor 129.

Bins 110 are closely spaced and are adapted to be raised into an open position to enable a reliable feed-in of the copy sheets. The bins 110 are vertically positioned one above the other and are angled down and away from the transport 125 at an angle of approximately 15°. In this manner the copy sheets moving downward on the transport 125 are directed into each of the bins by a movably mounted bin feeder and lifting device 140. Bins 110 are received through slots 132 formed in the frame and are secured to the frame by a common retaining plate 133. Plate 133 engages a tongue portion 134 of each bin 110 to retain the bins while enabling pivotal movement relative to the frame. At the inlet of each bin 110 is a pair of pivotal fingers 135 which are received in slides 137 to the bins.

Bin feeder and lifting device 140 includes a pair of finger actutating cams 142 which translate along the sheet path between the vertical extent of the bins. Cams 142 are secured to a carriage 147 which extends along the width of the transport 125. Carriage 147 is driven by two helix screws 150 and 151 driven by a motor spring (FIG. 6) to guide the carriage from the top to the bottom bin. The motion is stepped or intermittent from bin to bin upon a single revolution of a latched device 162 which is released by a solenoid signal from a switch 165 indicating the trail edge of the sheet has passed and the sheet is entering the bin. An electromagnetic clutch 163 is driven by main drive motor 129 upon a signal from the processor provides the opposite direction motion for the reset of the carriage at the bin at the bottom. It is during this rewind movement that the motor spring 160 is again tensioned. The step rotation of the screws 150, 151 effects the vertical movement of the carriage and fingers along the vertical transport 125 at the inlets of the bins.

Bins 110 are pivotally mounted and rest on top of fingers 135. Pivoting into an opened feed-in position is accomplished by cams 142 as they move downwardly causing the previous or upper bin to pivot upwardly as the cams strike the fingers 135 which are pivotally mounted resting on stop pins 136 on assembly 103. Simultaneously each copy sheet is directed into the appropriate bin by the action of deflector members 145 mounted on the carriage. Cams 142 are pivotable to rotate around the fingers during reset of the carriage.

In operation the sorting apparatus of the invention has two modes of operation. Upon depressing switch button S3 the sorter is off with all copies delivered to the main tray 115 by deflector fingers 180 on assembly 101. For the sorting mode of operation deflector fingers 180 are activated by pressing switch button S2 on copy sheets exiting from the processor are deflected onto the underside of the transport 120. Copy sheets are advanced horizontally by the transport 120 and then turned at an angle about 80° downwardly onto the transport 125. Copy sheets moving downwardly on transport 125 are directed into bins 110 by the bin feeder and lifting device 140 which is stepped along the inlets of the bins 110. At the same time the previous bin is pivoted open and the copy sheet deflected thereon. In the event there is an excess number of copies for the bins or a jam the sheets are automatically fed into tray 115 which serves as an overflow tray.

While there have been shown and described and pointed out the fundamental novel features of the invention as applied to a preferred embodiment it will be understood that various omissions and substitutions and changes in the form and details of the device illustrated and its operation may be made by those skilled in the art without departing from the spirit of the invention.

What is claimed is:

1. Sheet sorting apparatus comprising:

a plurality of bins for receiving copy sheet, transport means for advancing sheets along a path past the inlets of the bins, screw means extending in the direction of said transport means adjacent thereto, carriage means including a plurality of deflector members supported by said screw means and adapted to be moved by rotation thereof, drive means for rotating said screw means to advance the carriage means past the inlets of the sorting bins, said drive means including motor spring means driving a single revolution latching device, and clutch means connected to said transport means for rewinding said motor spring means for retensioning thereof after a sorting run past the bins.

2. Apparatus according to claim 1 wherein said bins are pivotably mounted and wherein camming means mounted on said carriage means pivot finger means associated with each of said bins as a copy sheet enters therein.

3. Apparatus according to claim 2 wherein said camming means moves downwardly and pivots open the previous upper bin at the same time that a sheet enters the appropriate bin.

4. Apparatus according to claim 2 wherein said camming is pivotably displaced around said finger means upon reset of said carriage means to its starting position.

5. Apparatus according to claim 1 wherein said transport means and said carriage means are supported on a common housing which is pivotable for movement away from said bins.

* * * * *